US006089959A

United States Patent [19]

Nagahashi

[11] Patent Number: 6,089,959

[45] Date of Patent: Jul. 18, 2000

[54] POLISHING METHOD AND POLISHING APPARATUS

[75] Inventor: Isao Nagahashi, Fujisawa, Japan

[73] Assignee: System Seiko Co., Ltd., Niigata, Japan

[21] Appl. No.: 09/255,682

[22] Filed: Feb. 23, 1999

[30] Foreign Application Priority Data

Oct. 23, 1998 [JP] Japan ..... 10-302908

[51] Int. Cl.[7] ..... B24B 7/00; B24B 5/00

[52] U.S. Cl. ..... 451/262; 451/269

[58] Field of Search ..... 451/262, 264, 451/267, 268, 269, 270, 271

[56] References Cited

U.S. PATENT DOCUMENTS

| | | | |
|---|---|---|---|
| 2,291,123 | 8/1994 | Wallace | 451/268 |
| 3,774,348 | 11/1973 | Dunn | 451/262 |
| 4,665,658 | 5/1987 | Carcey | 451/271 |
| 5,140,774 | 8/1992 | Onodera | 451/269 |
| 5,333,413 | 8/1994 | Hashimoto | 451/269 |

FOREIGN PATENT DOCUMENTS

| | | | |
|---|---|---|---|
| 3-149179 | 6/1991 | Japan | B24B 37/04 |

*Primary Examiner*—Rodney A. Butler

*Attorney, Agent, or Firm*—McCormick, Paulding & Huber LLP

[57] ABSTRACT

There is provided a polishing apparatus and a polishing method for use with the apparatus. The apparatus includes a lower turn table having a polishing surface on its upper surface, an upper turn table having a polishing surface on its lower surface, and in addition, an intermediate turn table having polishing surfaces on its upper and lower surfaces and interposed between the lower turn table and the upper turn table. The apparatus further includes a carrier rotating mechanism adaptable to rotate a disk-like carrier rotating on its axis while revolve the disk-like carrier around the rotational axis of the turn tables, and a table rotating mechanism for rotating the turn tables. The carriers can be prepared not only on the lower turn table but the intermediate turn table, and works can be loaded on the carriers prepared on the lower and intermediate turn tables. The works polished at a unit of machine operation is so many that productivity is improved.

18 Claims, 6 Drawing Sheets

POLISHING METHOD AND POLISHING APPARATUS

BACKGROUND OF THE INVENTION

1. Field of the Invention

The present invention generally relates to the technology for polishing works having a circular outer periphery such as substrates of magnetic disks.

2. Related Art Statement

There is known a polishing apparatus which is adapted to polish a plurality of substrates of magnetic disks in a mass producing fashion. One of such apparatus includes a pair of turn tables which are provided in a lower position and an upper position, respectively, so as to oppose each other. The lower turn table, which is provided at the lower position, has a polishing surface on its upper surface while the upper turn table, which is provided at the upper position, has a polishing surface on its lower surface, whereby the polishing surface of the lower turn table and the polishing surface of the upper turn table are disposed in an opposing fashion.

Then, plural sheets of disk-like carriers are provided on the upper surface of the lower turn table. Each of the carriers is provided with at least one aperture, and a work such as a magnetic disk substrate or the like is held within the aperture. The each of the carriers also has a gear formed on its circular periphery so that the gear can be engaged with an internal gear provided at the outer periphery of the lower turn table and a sun gear arranged on a sun gear shaft that is coaxial with a rotary shaft of the lower turn table.

As the sun gear is driven to rotate in one direction and the internal gear also is driven to rotate in a direction opposite to that direction, each of the carriers holding a number of works therein revolves around the sun gear while rotates on its own axis. By the way, either one of the sun gear and the internal gear may be kept stationary to maintain the revolution and rotation at the same time.

The upper turn table is coupled to a lifting and lowering mechanism so that the upper turn table can be lifted to enable an operator to access the carriers on the lower turn table and also can be lowered to bring the upper turn table to contact to the carrier surface. The upper turn table is lowered to contact to the carrier and the upper and lower turn tables are rotated, then the carriers holding works therein will move in a sliding fashion between the upper and lower polishing surfaces while maintaining the above-described revolution and rotation. In this way, both the upper and lower surfaces of the works are polished. A polishing apparatus having the above-described arrangement is disclosed in, for example, Japanese Patent Application Laid-Open Gazette No. 3-149179.

The process for manufacturing substrates of magnetic disks includes many polishing steps, and thus such process requires a lot of time to execute. After cutting a raw substrate that is typically made of aluminum or glass into a disk-shape, the process goes into many steps of polishing. For example, the process includes a grinding step for grinding the surface of a work or substrate by means of a grinder, a lapping step for improving the finish of the work and a polishing step for providing the work with a high precision surface profile. For lapping and polishing, a polishing tool such as a polishing pad or a buff is used in a polishing apparatus of the above described type.

The nature of the process tells us that several polishing steps are carried out by commonly utilizing substantially the same polishing apparatus. In other words, the aforesaid polishing steps, or the grinding, lapping and polishing processes, are carried out by an apparatus having substantially the same configuration. Therefore, it is requested to provide a method and an apparatus which enable a number of works to be polished in an efficient mass production manner on the floor of a limited area on which the apparatus will be provided.

It is an object of the present invention to provide a method and an apparatus that can increase the number of works to be polished simultaneously.

It is another object of the present invention to provide a method and an apparatus that can improve productivity in polishing works or the like.

It is still another object of the present invention in which a working area on which the aforesaid apparatus will be provided can be utilized efficiently.

SUMMARY OF THE INVENTION

According to one aspect of the present invention, there is provided a polishing apparatus including a lower turn table having a polishing surface on its upper surface with a rotational axis, an upper turn table having a polishing surface on its lower surface and provided so as to have a rotational axis coaxial with the rotational axis of the lower turn table, an intermediate turn table having polishing surfaces on its upper and lower surfaces and interposed between the lower turn table and the upper turn table so as to have a rotational axis coaxial with the rotational axis of the upper and lower turn tables, disk-like carriers with a plurality of apertures provided on the upper surface of the lower turn table and the upper surface of the intermediate turn table, a carrier rotating mechanism for rotating each of the carriers on axis thereof while revolving the same around the rotational axis of the turn tables, and a table rotating mechanism for driving the lower, upper and intermediate turn tables.

According to another aspect of the present invention, there is provided a polishing method for use with an apparatus including a lower turn table having a polishing surface on its upper surface with a rotational axis, an upper turn table having a polishing surface on its lower surface and provided so as to have a rotational axis coaxial with the rotational axis of the lower turn table, an intermediate turn table having polishing surfaces on its upper and lower surfaces and interposed between the lower turn table and the upper turn table so as to have a rotational axis coaxial with the rotational axis of the upper and lower turn tables, a carrier rotating mechanism adaptable to rotate disk-like carriers on the axis thereof while revolve the same around the rotational axis of the turn tables, and a table rotating mechanism for rotating the tables on rotational axis thereof, comprising the steps of preparing disk-like carriers with a plurality of apertures on the upper surface of the lower turn table and the upper surface of the intermediate turn table, charging works into the carriers at the apertures thereof, and rotating each of the carriers on axis thereof while revolving the carriers around the rotational axis of the turn tables simultaneously with rotating the lower, upper and intermediate turn tables.

According to another aspect of the present invention, there is provided a polishing apparatus including a lower turn table having a polishing surface on its upper surface with a rotational axis, an upper turn table having a polishing surface on its lower surface and provided so as to have a rotational axis coaxial with the rotational axis of the lower turn table, an intermediate turn table having polishing surfaces on its upper and lower surfaces and interposed between the lower turn table and the upper turn table so as to have a rotational axis coaxial with the rotational axis of the upper and lower turn tables, a lifting and lowering mechanism for lifting and lowering the intermediate turn table and the upper turn table, a carrier rotating mechanism for rotating each of the carriers on axis thereof while revolving the carriers around the rotational axis of the turn tables, and a table rotating mechanism for driving the lower, upper and intermediate turn tables.

According to still another aspect of the present invention, there is provided a polishing method for use with an apparatus including a lower turn table having a polishing surface on its upper surface with a rotational axis, an upper turn table having a polishing surface on its lower surface and provided so as to have a rotational axis coaxial with the rotational axis of the lower turn table, an intermediate turn table having polishing surfaces on its upper and lower surfaces and interposed between the lower turn table and the upper turn table so as to have a rotational axis coaxial with the rotational axis of the upper and lower turn tables, a lifting and lowering mechanism for lifting and lowering the intermediate turn table and the upper turn table, a carrier rotating mechanism adaptable to rotate a disk-like carrier on the axis thereof while revolve the same around the rotational axis of the turn tables, and a table rotating mechanism for rotating the tables on rotational axis thereof, comprising the steps of lifting the intermediate turn table and the upper turn table so as to allow access to the carriers on the lower turn table and upper turn table, preparing disk-like carriers with a plurality of apertures on the upper surface of the lower turn table and the upper surface of the intermediate turn table, charging works into the carriers at the apertures thereof, lowering the intermediate turn table and the upper turn table so that both the turn tables are brought to contact to the works held in the carriers on the lower turn table and the intermediate turn table, respectively, and rotating each of the carriers on axis thereof while revolving the carriers around the rotational axis of the turn tables simultaneously with rotating the lower, upper and intermediate turn tables.

DETAILED DESCRIPTION OF THE PREFERRED EMBODIMENT

Now, the present invention will be described with reference to the accompanying drawings that illustrate a preferred embodiment of the invention.

Figure 1:
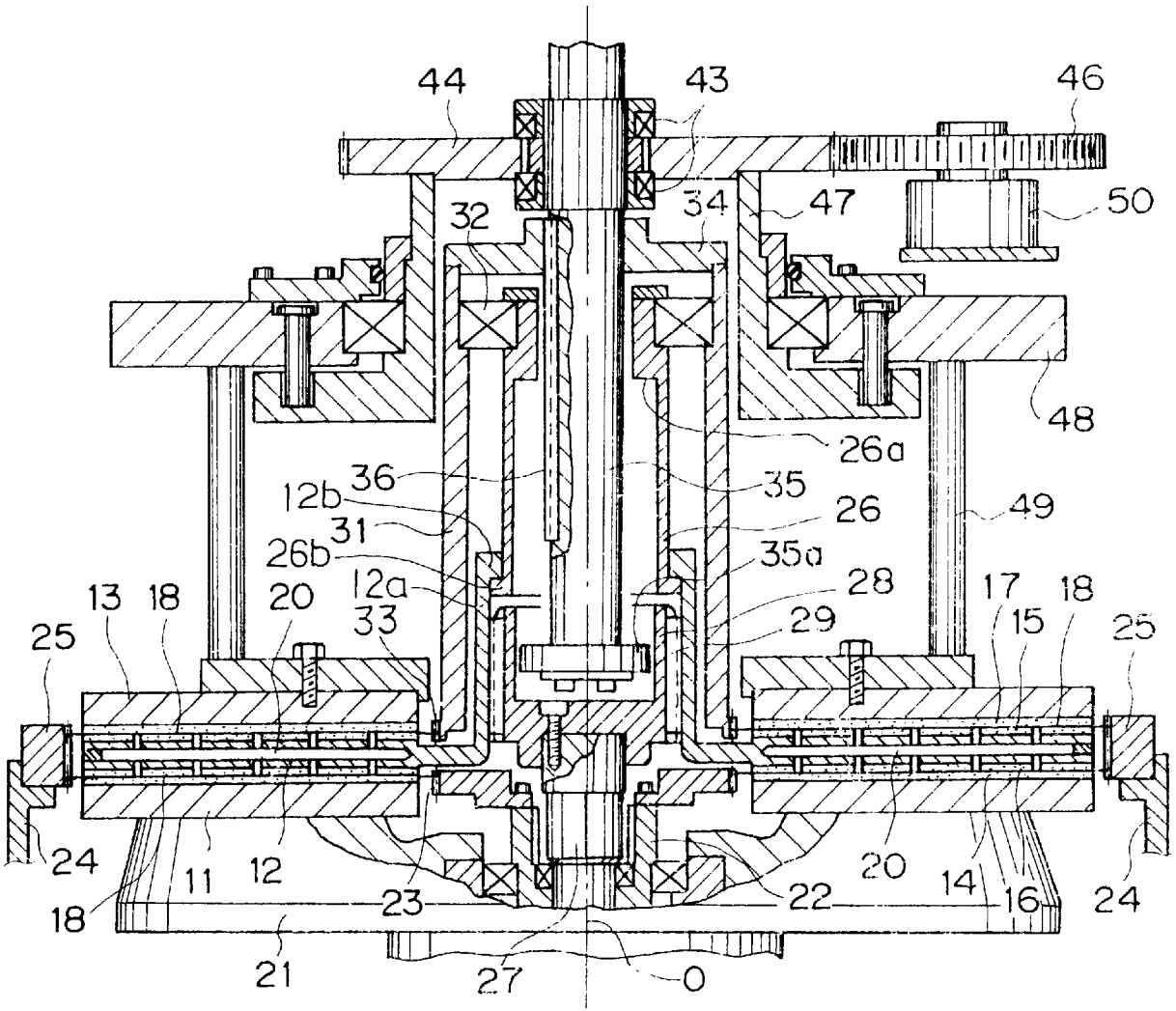
FIG. 1 is a schematic cross sectional view of a main portion of an embodiment of the polishing apparatus according to the present invention.
Figure 2:
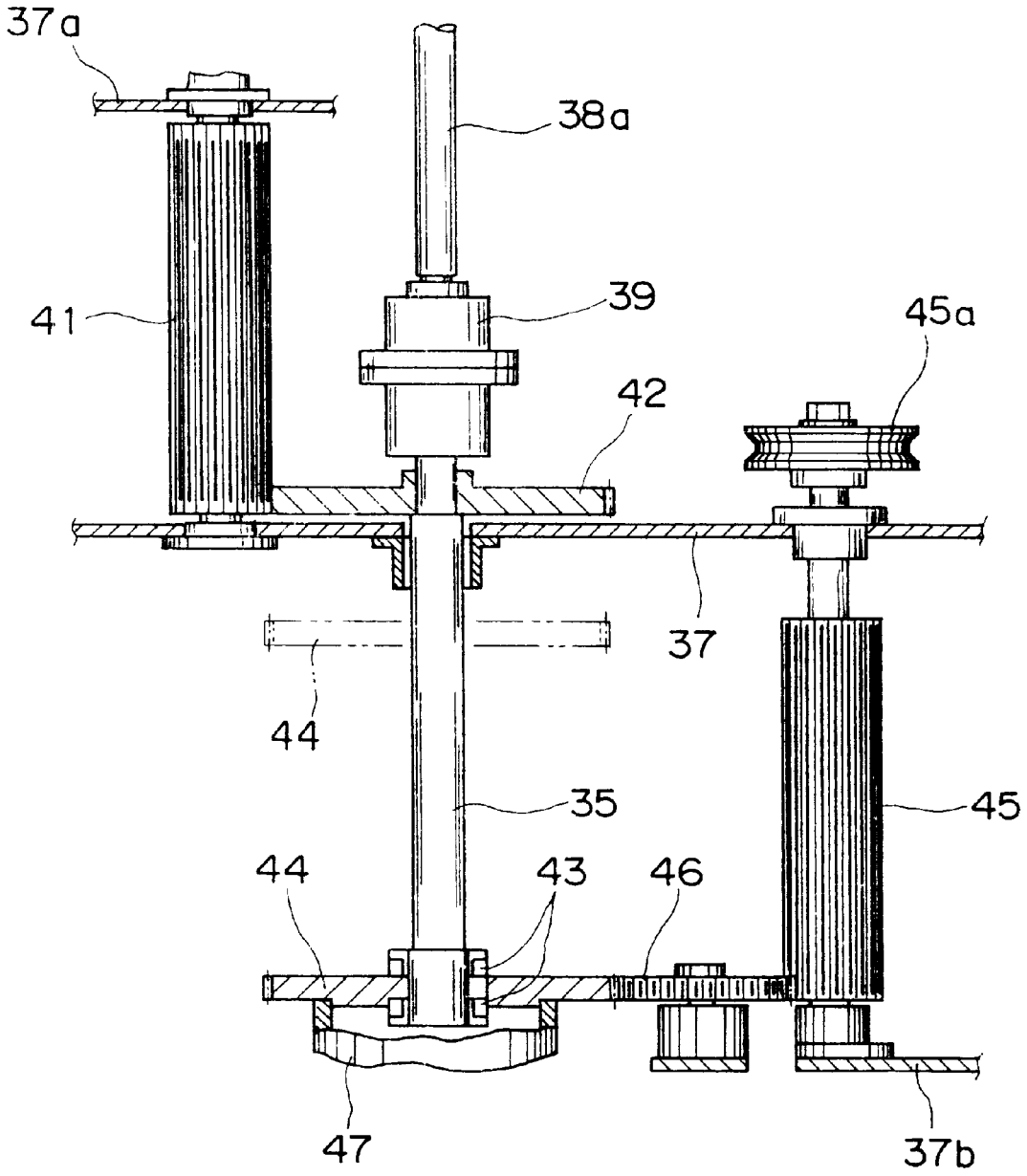
FIG. 2 is a partial cross sectional view of an upper portion of the embodiment according to the present invention.
Figure 3:
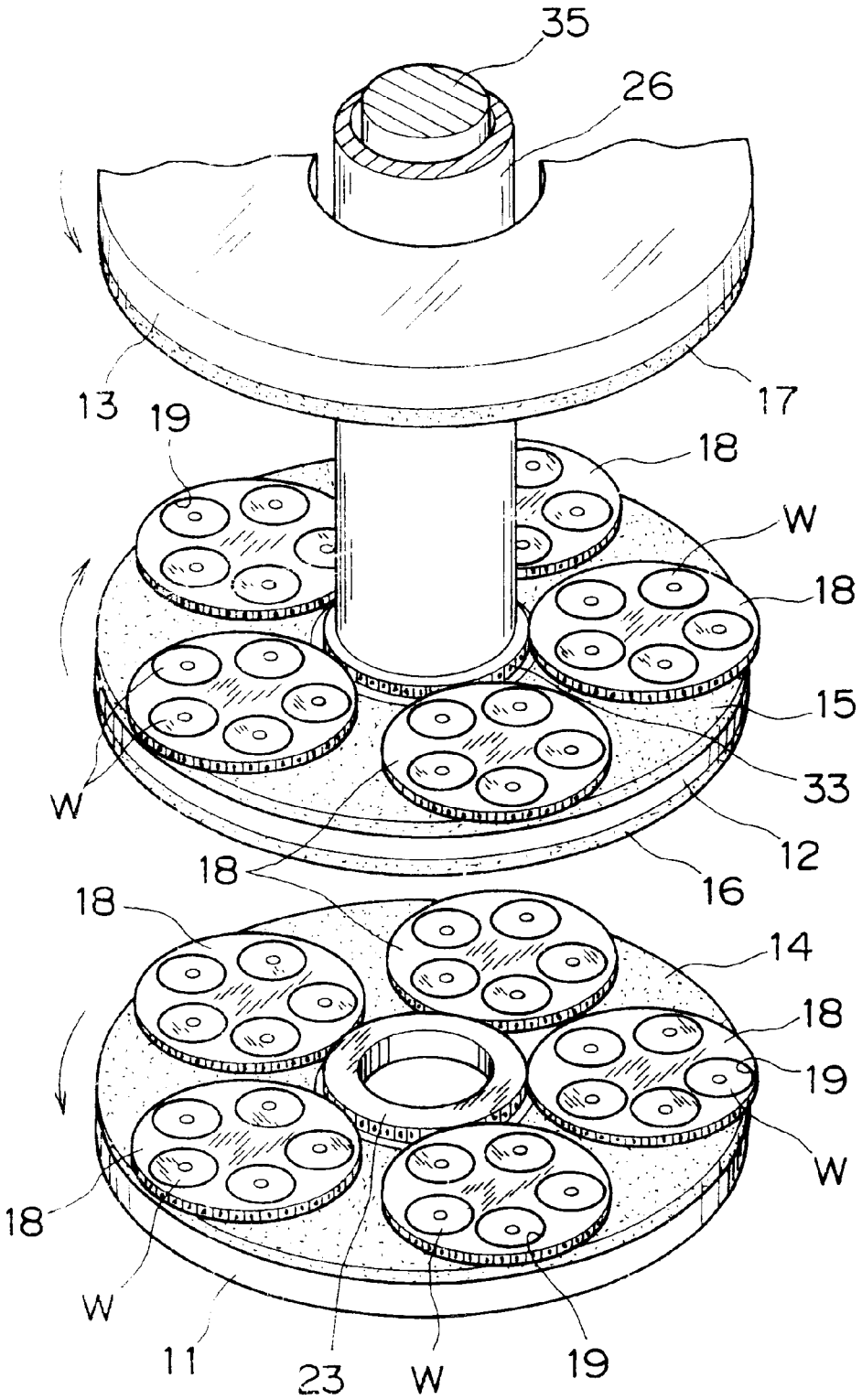
FIG. 3 is an exploded perspective view of the upper, lower and intermediate turn tables of the embodiment according to the present invention.

FIG. 1 is a schematic cross sectional view of an embodiment of a polishing apparatus according to the invention, showing a principal area thereof and FIG. 2 is a schematic cross sectional view of the embodiment of FIG. 1, showing an upper portion of the polishing apparatus of FIG. 1, whereas FIG. 3 is an exploded perspective view of the upper, lower and intermediate turn tables of the polishing apparatus of FIG. 1 and FIGS. 4 through 6 are schematic illustration of the embodiment of polishing apparatus of FIG. 1, each of them showing different stage of operation.

The illustrated polishing apparatus includes a lower turn table 11, an intermediate turn table 12 and an upper turn table 13. As shown in FIG. 3, the lower turn table 11 has a polishing tool 14 attached to the upper surface thereof, the intermediate turn table 12 has polishing tools 15 and 16 attached to the upper and lower surfaces thereof, respectively. The upper turn table 13 has a polishing tool 17 attached to the lower surface thereof. Grinding works W of the embodiment are substrates of magnetic disks having a circular outer periphery and thus the works can be held in apertures formed in carriers which will be described later on. The grinding works are generally made of aluminum, glass or the like. Grinding stone may be used when the works are subject to grinding as an initial polishing. Thus, the grinding stone is employed as the polishing tools 14 through 17. When the works are subject to finer grinding such as lapping or polishing than with grinding stone, another polishing tool such as buff may be employed for the polishing tools 14 through 17. Therefore, it is desirable for the polishing tools 14 through 17 to be removable from the turn tables 11 through 13.

A plurality of work carriers 18 are made to have a plural number of apertures so that each carrier can hold works in the apertures. The work carriers are provided on the polishing tool 14 of the lower turn table 11 so that the work is held on the polishing surface of the polishing tool. Each carrier 18 has a thickness smaller than that of the works W so that both the major surfaces of the work can slightly protrude from the major surfaces of the carrier and abut against the polishing tool directly. Each carrier has gear teeth formed on the outer peripheral surface thereof and the gear of the carrier is brought into engagement with a sun gear and an internal gear, which will be described later on, when the carrier is disposed on the polishing tool 15 of the turn table. Note that works W are not shown in FIG. 1 and both the works W and the carriers 18 are made to show a disproportionately large thickness in FIG. 3.

While each of the polishing tools 14 and 15 are adapted to hold five carriers 18 in FIG. 3, the number of carriers 18 that can be held by each of the polishing tools 14 and 15 is not limited thereto and, alternatively, the polishing tools 14 and 15 may be made to hold any appropriate number of carriers 18 other than five, say, 7 or 10 for instance. Additionally, an appropriate number of apertures may be bored through each carrier 18.

As will be understood from FIG. 1, polishing solution feed holes 20 are bored through the intermediate turn table 12 so that polishing solution may be supplied onto the surfaces of the polishing tools 15 and 16 through the respective polishing solution feed holes 20. However, polishing solution may additionally be fed through nozzles arranged outside the turn table 12 or, alternatively, polishing solution may be fed to the lower turn table 11 and the upper turn table 13.

As shown in FIG. 1, the lower turn table 11 is rigidly secured to a rotary member 21 by coupling means (not shown) so that the lower turn table 11 is driven to rotate in a horizontal plane by rotation of the rotary member 21 around its axis of rotation O. A hollow rotary shaft 22 is rotatably fitted to the center of the rotary member 21 and a sun gear 23 is fitted to the hollow rotary shaft 22 so as to be held in engagement with the carriers 18 that are provided on the polishing tool 14 of the lower turn table 11. An annular rotary member 24 having an annular internal gear 25 formed on the internal surface of the annual rotary member is provided at the outer periphery of the lower turn table 11 so that the annular internal gear 25 is held in engagement with the carriers 18. Thus, the carriers 18 are driven to rotate by both the sun gear 23 and the internal gear 25. While both of the sun gear 23 and the internal gear 25 are driven to rotate the carriers, either of the sun gear 23 and the internal gear 25 may alternatively be kept stationary and only one of the sun gear 23 and the internal gear 25 is driven to rotate the carriers 18.

The intermediate turn table 12 has a cylindrical projecting portion 12*a* formed at the center thereof and the cylindrical projecting portion 12*a* has at its upper end portion a hook portion 12*b* projecting inward in a circular fashion. A sleeve member 26 having a hook portion 26*a* and a projecting portion 26*b* is arranged coaxially with the intermediate turn table and provide above the cylindrical projecting portion 12*a* so that the projecting portion 26*b* can abut against the under face of the hook portion 12*b* when the sleeve member 26 is lifted upward. The cylindrical projecting portion 12*a* is coupled to an engaging member 28 fixed to the top of a drive shaft 27 by way of a sliding key 29. Thus, when the drive shaft 27 is driven to rotate, the rotation is transmitted through the engaging member 28 and the sliding key 29 to the cylindrical projecting portion 12*a*, thereby to rotate the intermediate turn table 12.

A drive sleeve 31 is arranged so that it can accommodate the sleeve member 26. A radial bearing 32 is interposed between the drive sleeve 31 and the sleeve member 26 so as to rotatable support the drive sleeve 31 relative to the sleeve member 26. A sun gear 33 is formed at the lower end of the drive sleeve 31 to be held in engagement with the carriers 18 placed on the polishing tool 15 on the intermediate turn table 12. The carriers 18 placed on the polishing tool 15 on the intermediate turn table 12 will engage not only with the sun gear 33 but also with the internal gear 25 in a similar manner as that of the carriers 18 on the polishing tool 14 on the lower turn table 11.

An end plate 34 is rigidly secured to the drive sleeve 31. A drive shaft 35 is provided coaxially with the drive sleeve 31 so as to extend through the end plate 34 into the sleeve member 26. The drive shaft 35 is provided with a sliding key 36 to be held in engagement with the end plate 34 so that the rotary motion of the drive shaft 35 is transmitted by way of the sliding key 36 and the end plate 34 to the drive sleeve 31. While the drive shaft 35 and the end plate 34 are brought to engagement with each other by way of the sliding key 36, the sliding key may be omitted and the drive shaft 35 and the end plate 34 may be engaged with each other by gears and/or splines.

Figure 4:
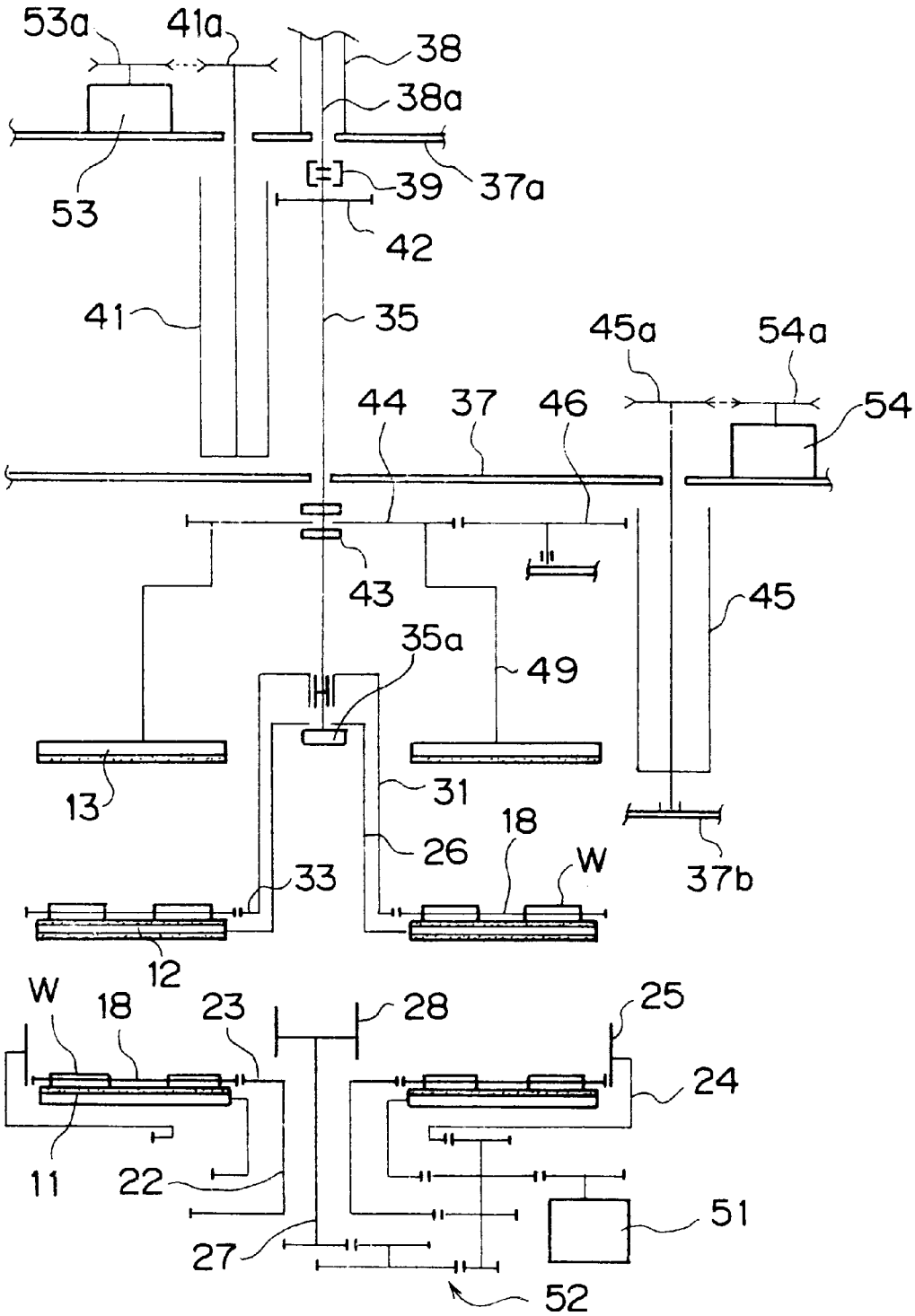
FIG. 4 is a schematic illustration of the embodiment of the polishing apparatus according to the present invention in which the intermediate and upper turn tables are lifted.

As shown in FIG. 2, the drive shaft 35 is supported by a support table 37 so that the drive shaft 35 can rotate and slide vertically relative to the support table 37. The drive shaft 35 is coupled by way of a joint section 39 to a pneumatic cylinder 38 which is supported on another support table 37*a* provided above the support table 37 as shown in FIG. 4. With this construction, the drive shaft 35 can be lifted or lowered in the vertical direction by the pneumatic cylinder 38. While in the embodiment described so far the drive shaft 35 is lifted and lowered by the pneumatic cylinder 38, the drive shaft 35 may be lifted or lowered by some other means such as a hydraulic cylinder or an electric motor arranged to vertically move the drive shaft 35.

The drive shaft 35 is arranged to have a stopper 35*a* at the lower end thereof so that the stopper 35*a* may abut against the hook portion 26*a* of the sleeve member 26 when the drive shaft 35 is lifted by a predetermined stroke. When the drive shaft 35 is lifted further while keeping contact of the stopper 35*a* with the hook portion 26*a*, the drive shaft 35 lifts the sleeve member 26, also lifting the drive sleeve 31 together with the intermediate turn table 12.

The drive shaft 35 is driven by a gear 42 which is fixed to the drive shaft 35 and engaged with a spline 41. As shown in FIG. 2, the spline 41 is made to extend between the support table 37 and the support table 37*a* so that the gear 42 is maintained in engagement with the spline 41 even if the gear 42 is lifted or lowered together with the drive shaft 35.

As shown in FIG. 2, a gear 44 is rotatably engaged with the drive shaft 35 by means of a thrust bearing 43. The gear 44 is meshed with a gear 46, and the gear 46 is meshed with a spline 45. The spline 45 is also made to extend between the support table 37 and a support table 37*b* so that the gear 46 is maintained in engagement with the spline 45 even if the gear 46 is lifted or lowered together with the gear 44 and the driving shaft 35.

The gear 44 is made integral with an upper turn table drive member 47, and the upper turn table drive member 47 is rigidly secured to a drive disk 48, which is fixed to the upper turn table 13 by way of a coupling rod 49. When the gear 44 is rotated, the rotation is transmitted from the gear 44 through the upper turn table drive member 47, and the drive disk 48 and the coupling rod 49 to the upper turn table 13. The gear 46 is rotatably supported by a bearing unit 50 as shown in FIG. 1, and the bearing unit 50 is arranged to be lifted or lowered together with the drive shaft 35 so that the engagement between the gears 44 and 46 is maintained regardless of the lifting and lowering motion of the drive shaft 35.

As shown in FIG. 4, the lower turn table 11, the sun gear 23, the intermediate turn table 12 and the internal gear 25 are arranged to be driven in a synchronizing fashion by a drive motor 51 by way of a gear train 52. In the embodiment shown in the Figure, the internal gear 25 is supported on the annular rotary member 24 and is meshed with the gear train 52 in order that the internal gear 25 is also driven by the motor 51. However, if the internal gear 25 is not driven to rotate but kept stationary, it may be kept disengaged from the gear train 52.

The sun gear 33 is driven to rotate by a motor 53 provided on the support table 37*a*. The rotation is transmitted from a pulley 53*a* rigidly secured to the shaft of the motor 53 by way of a belt to a pulley 41*a* which is linked to the spline 41.

The upper turn table 13 is driven to rotate by a motor 54 provided on the support table 37. The rotation is transmitted from a pulley 54*a* rigidly secured to the shaft of the motor 54 by way of a belt to a pulley 45*a* rigidly secured to the spline 45.

Now, the following is a description for the process for polishing both of the right and reverse major surfaces of the works W prepared on the carriers in a mass production fashion carried out by the above polishing apparatus.

FIG. 4 shows a stage of operation of the polishing apparatus according to the present invention where the pneumatic cylinder 38 lifts the drive shaft 35 up to the upper limit, whereby the intermediate turn table 12 is brought apart from and located above the lower turn table 11 while the upper turn table 13 is also brought apart from and located above the intermediate turn table 12. A predetermined number of carriers are prepared on the polishing tool 14 of the lower turn table 11 and the polishing tool 15 of the intermediate turn table 12.

In the stage of operation shown in FIG. 4, since the intermediate turn table 12 is brought apart from and located above the lower turn table 11 while the upper turn table 13 is also brought apart from and located above the intermediate turn table 12, it is possible for an operator to access the carriers provided on the lower turn table 11 and the intermediate turn table 12 to load works such as magnetic disks or the like into the carriers at respective work receiving apertures 19. This work charging step may be started either from the upper layer or from the lower layer or it may be started at the upper and lower layers simultaneously.

After the work charging step, the drive shaft 35 lowers the upper turn table assembly together with the intermediate turn table assembly which is suspended by the drive shaft 35 at the stopper 35*a*. If the drive shaft 35 is lowered by a predetermined stroke, the intermediate turn table assembly will abut at its lower surface polishing tool 16 against the upper surfaces of the carriers provided on the lower turn table 11, as shown in FIG. 5.

Subsequently, when the drive shaft 35 is further lowered, the intermediate turn table assembly is left on the lower turn table 11 and the stopper 35*a* leaves from the contact surface 26*a* of the sleeve member 26. Then, the upper turn table assembly can be lowered until the polishing tool 17 of the upper turn table 13 comes to contact to the works W on the intermediate turn table 12, as shown in FIG. 6.

Figure 5:
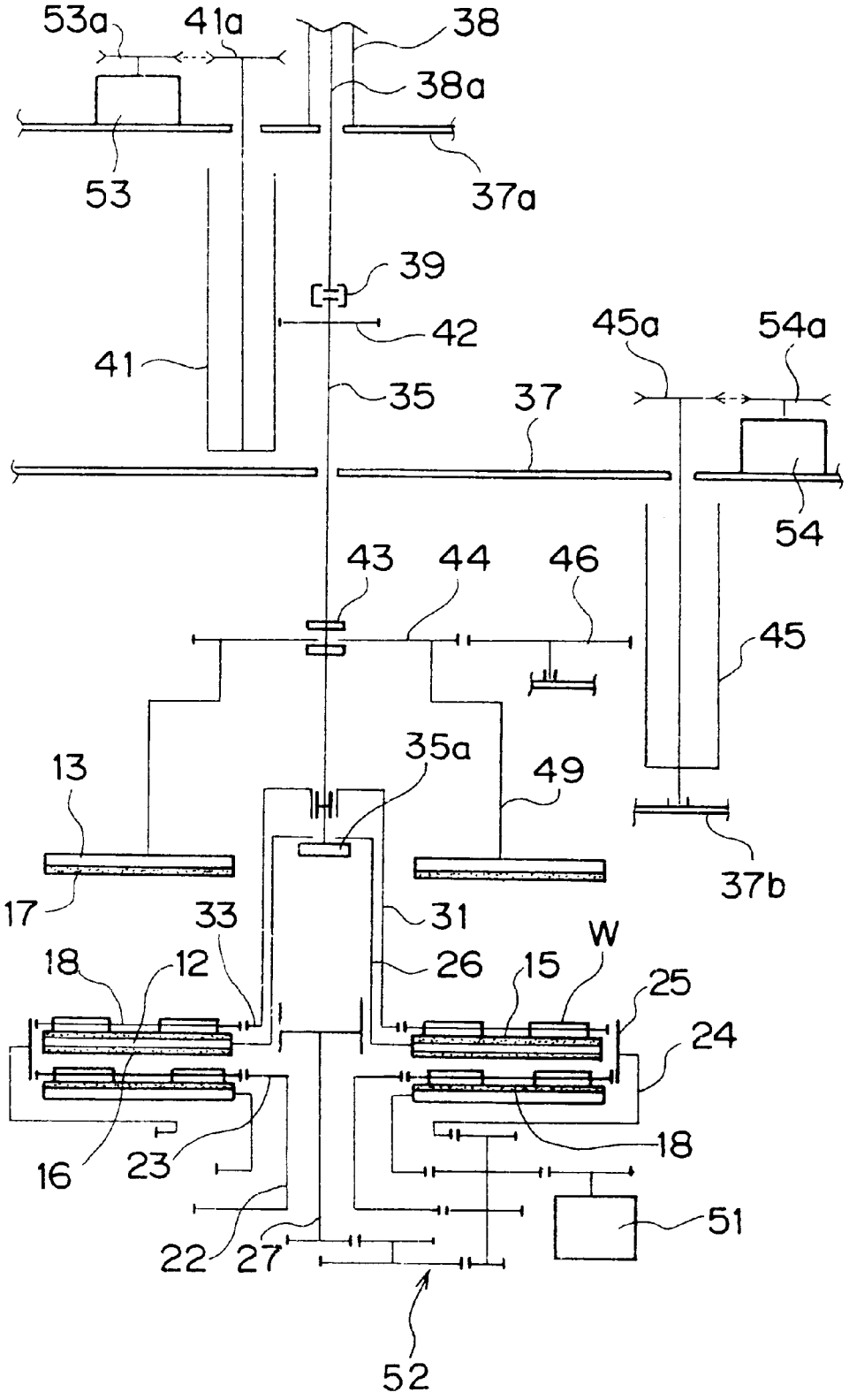
FIG. 5 is another schematic illustration of the embodiment of the polishing apparatus according to the present invention in which the intermediate turn table is lowered to contact to works on the lower turn table.
Figure 6:
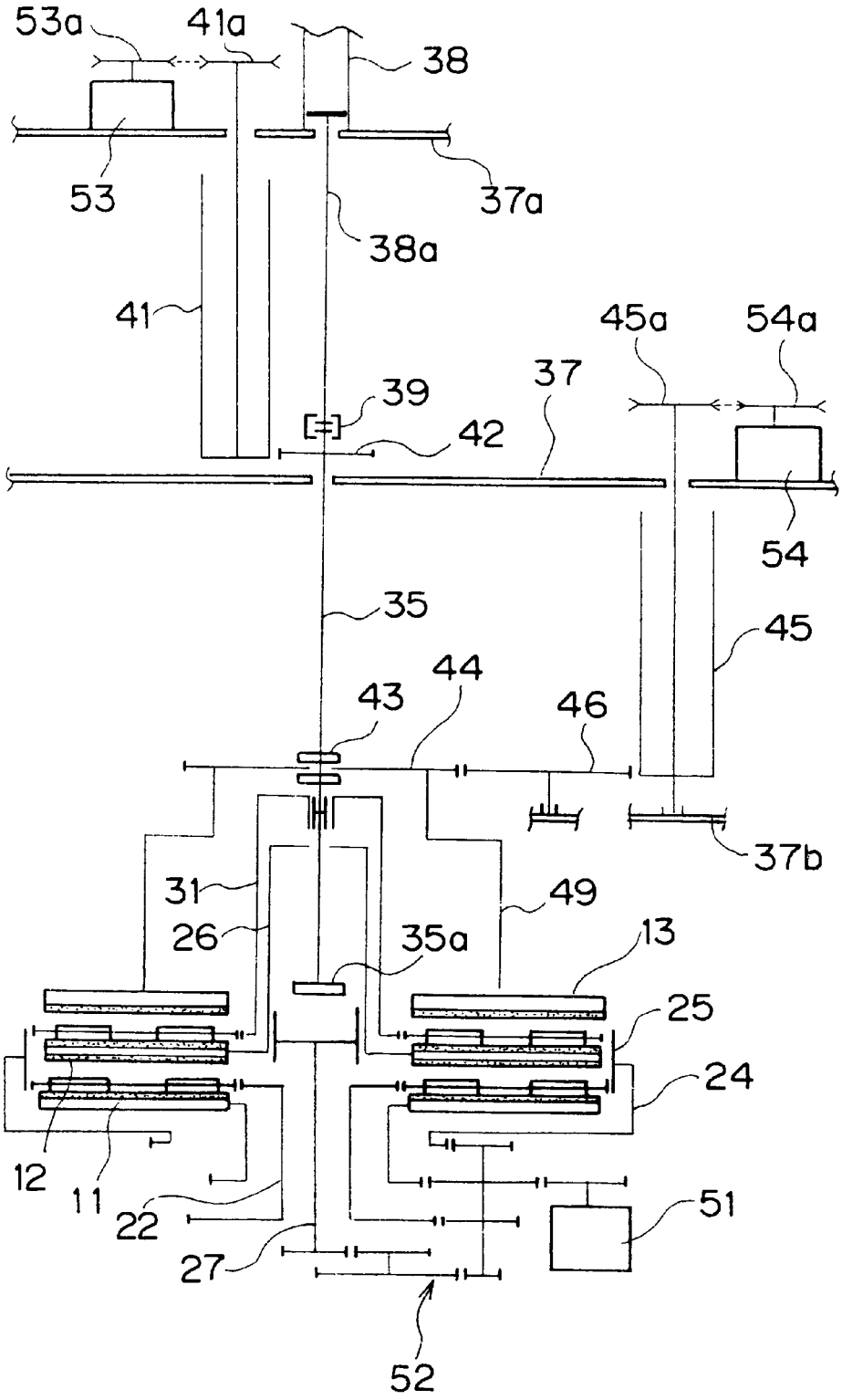
FIG. 6 is still another schematic illustration of the embodiment of the polishing apparatus according to the present invention in which the upper and the intermediate turn tables are lowered to contact to works on the intermediate and the lower turn tables, respectively.

After the upper turn table assembly and the intermediate turn table assembly are lowered as illustrated in FIGS. 5 and 6, the works in the carriers 18 provided on both the lower turn table and the intermediate turn table are sandwiched between the polishing tools 14 and 16 and between the polishing tools 15 and 17, respectively.

As the motors 51 and 53 are driven under this condition, the sun gears 23 and 33 and the internal gear 25 are driven to rotate the carriers 18, resulting in rotation of the carriers 18 on its axis while revolution around the sun gears 23 and 33 with forming a cycloidal or trochoidal locus in the horizontal plane on the turn table.

Further, when the motors 51 and 54 drive to rotate the upper, intermediate and lower turn tables 11, 12 and 13, the works held in the carriers become subject to relative motion which is brought about between the turn tables and the carriers on the turn tables while they are held in contact with polishing tools on the opposing sides thereof. During this rotary operation, polishing solution is fed to the opposite surfaces of the works W from the respective polishing solution feed holes 20.

While rotation directions for the three turn tables 11 through 13 may be arbitrarily selected, it is desirable to select the directions of rotation so that adjacent two turn tables are rotated in the directions opposite to each other, as shown in FIG. 3.

When the polishing operation is over, the upper turn table 13 and the intermediate turn table 12 are lifted to bring about the stage of FIG. 4 from the operation stage shown in FIG. 6 through the stage of FIG. 5. When the stage of FIG. 4 is brought about to allow access to the works, the polished works W are taken out of the carriers and new unpolished works W are loaded on the carriers 18.

As will be understood from the above description, according to the polishing apparatus of the present invention, carriers 18 can be provided on not only the lower turn table but the intermediate turn table. Therefore, it is possible to provide twice the number of carriers in the polishing apparatus, and hence it is possible to polish twice the number of works with the same operation time, compared with a case that polishing is carried out with an apparatus with a single turn table for providing carriers thereon.

For example, when ten carriers 18, each capable of containing five works, are provided on each of the turn tables, then 100 works in total can be polished simultaneously at the opposite sides thereof by a polishing apparatus according to the invention. Therefore, it is possible to utilize efficiently the space for the apparatus, and thus the productivity of the space will be improved.

Moreover, the polishing tools to be attached to the apparatus can be arbitrarily selected depending on the polishing stage for the works. For example, grinding stone is utilized for the polishing tools 14 through 17 for subjecting the works to grinding and buff is utilized for the polishing tools 14 through 17 for subjecting the works to lapping and/or polishing. In addition, different polishing rates with different grain sizes can be arbitrarily selected depending on the desired polishing stage. Important thing is that the same polishing apparatus according to the present invention can be commonly utilized for carrying out each of these different polishing operations.

Furthermore, while in the apparatus according to the embodiment of the present invention the number of intermediate tables is one, it is needless to say that plural number of intermediate turn tables can be provided. In this case, the carrier rotating mechanism is also arranged to be capable of rotating carriers provided on each of the intermediate turn tables.

The present invention is not limited to the above described embodiment, and thus various changes and modifications can be effected without departing from the spirit and the scope of the invention.

For example, while only a single intermediate turn table is used in the above embodiment, more than one intermediate turn tables may be arranged in a polishing apparatus according to the invention.

What I claim is:

1. A polishing apparatus comprising:

a lower turn table having a polishing surface on its upper surface and a rotational axis;

an upper turn table having a polishing surface on its lower surface and provided so as to have a rotational axis coaxial with the rotational axis of the lower turn table;

an intermediate turn table having a polishing surface on its upper and lower surfaces and interposed between the lower turn table and the upper turn table so as to have a rotational axis coaxial with the rotational axis of the upper and lower turn tables;

disk-like carriers with a plurality of apertures provided on the upper surface of the lower turn table and the upper surface of the intermediate turn table;

a carrier rotating mechanism for rotating each of the carriers on axis thereof while revolving the carriers around the rotational axis of the turn tables; and a table rotating mechanism for driving the lower, upper and intermediate turn tables.

2. A polishing apparatus according to claim 1, in which the carrier rotating mechanism comprises an internal gear rotatable around the lower table and the intermediate table and a sun gear rotatable on the rotational axis of the turn tables, and each of the disk-like carriers has a gear on the outer periphery thereof meshing with the internal gear and the sun gear, whereby the carrier rotates on the axis thereof while revolving around the sun gear as the internal gear and the sun gear rotate.

3. A polishing apparatus according to claim 1, in which the carrier rotating mechanism comprises a stationary internal gear provided around the lower table and the intermediate table and a sun gear rotatable on the rotational axis of the turn tables, and each of the disk-like carriers has a gear on the outer periphery thereof meshing with the internal gear and the sun gear, whereby the carrier rotates on the axis thereof while revolving around the sun gear as the sun gear rotates.

4. A polishing apparatus according to claim 1, in which the carrier rotating mechanism comprises an internal gear rotatable around the lower table and the intermediate table and a sun gear stationary on the rotational axis of the turn tables, and each of the disk-like carriers has a gear on the outer periphery thereof meshing with the internal gear and the sun gear, whereby the carrier rotates on the axis thereof while revolving around the sun gear as the internal gear rotates.

5. A polishing apparatus according to claim 1, in which the lower turn table, the intermediate turn table and the upper turn table rotate in such a manner that any adjacent two out of the turn tables rotate in directions opposite to each other.

6. A polishing apparatus according to claim 1, in which a lifting and lowering mechanism for lifting and lowering the intermediate turn table and the upper turn table is included and comprises a drive shaft having a stopper at the end of the drive shaft, a sleeve member having a hook portion and a projecting portion, and the intermediate turn table has a cylindrical projecting portion with a hook portion, whereby the stopper abuts against the hook portion of the sleeve member and the projecting portion of the sleeve member abuts against the hook portion of the cylindrical projecting portion of the intermediate turn table when the drive shaft is driven upward to lift the sleeve member.

7. A polishing apparatus according to claim 1, in which the intermediate turn table has polishing solution feed holes bored so that polishing solution is supplied through the holes to the upper and lower surfaces thereof.

8. A polishing apparatus comprising:

a lower turn table having a polishing surface on its upper surface and a rotational axis;

an upper turn table having a polishing surface on its lower surface and provided so as to have a rotational axis coaxial with the rotational axis of the lower turn table;

an intermediate turn table having a polishing surface on its upper and lower surfaces and interposed between the lower turn table and the upper turn table so as to have a rotational axis coaxial with the rotational axis of the upper and lower turn tables;

a lifting and lowering mechanism for lifting and lowering the intermediate turn table and the upper turn table;

a carrier rotating mechanism for rotating each of the carriers on axis thereof while revolving the carriers around the rotational axis of the turn tables; and a table rotating mechanism for driving the lower, upper and intermediate turn tables.

9. A polishing apparatus according to claim 8, in which the carrier rotating mechanism comprises an internal gear rotatable around the lower table and the intermediate table and a sun gear rotatable on the rotational axis of the turn tables, and each of the disk-like carriers has a gear on the outer periphery thereof meshing with the internal gear and the sun gear, whereby the carrier rotates on the axis thereof while revolving around the sun gear as the internal gear and the sun gear rotate.

10. A polishing apparatus according to claim 8, in which the carrier rotating mechanism comprises a stationary internal gear provided around the lower table and the intermediate table and a sun gear rotatable on the rotational axis of the turn tables, and each of the disk-like carriers has a gear on the outer periphery thereof meshing with the internal gear and the sun gear, whereby the carrier rotates on the axis thereof while revolving around the sun gear as the sun gear rotates.

11. A polishing apparatus according to claim 8, in which the carrier rotating mechanism comprises an internal gear rotatable around the lower table and the intermediate table and a sun gear stationary on the rotational axis of the turn tables, and each of the disk-like carriers has a gear on the outer periphery thereof meshing with the internal gear and the sun gear, whereby the carrier rotates on the axis thereof while revolving around the sun gear as the internal gear rotates.

12. A polishing apparatus according to claim 8, in which the lower turn table, the intermediate turn table and the upper turn table rotate in such a manner that any adjacent two out of the turn tables rotate in directions opposite to each other.

13. A polishing apparatus according to claim 8, in which the lifting and lowering mechanism comprises a drive shaft having a stopper at the end of the drive shaft, a sleeve member having a hook portion and a projecting portion, and the intermediate turn table has a cylindrical projecting portion with a hook portion, whereby the stopper abuts against the hook portion of the sleeve member and the projecting portion of the sleeve member abuts against the hook portion of the cylindrical projecting portion of the intermediate turn table when the drive shaft is driven upward to lift the sleeve member.

14. A polishing apparatus according to claim 8, in which the intermediate turn table has polishing solution feed holes bored so that polishing solution is supplied through the holes to the upper and lower surfaces thereof.

15. A polishing apparatus comprising:

a lower turn table having a polishing surface on its upper surface and a rotational axis;

an upper turn table having a polishing surface on its lower surface and provided so as to have a rotational axis coaxial with the rotational axis of the lower turn table;

plural number of intermediate turn tables each having a polishing surface on its upper and lower surfaces and interposed between the lower turn table and the upper turn table so as to have a rotational axis coaxial with the rotational axis of the upper and lower turn tables;

disk-like carriers with a plurality of apertures provided on the upper surface of the lower turn table and the upper surface of each of the intermediate turn tables;

a carrier rotating mechanism for rotating each of the carriers on axis thereof while revolving the carriers around the rotational axis of the turn tables; and a table rotating mechanism for driving the lower, upper and intermediate turn tables.

16. A polishing method for use with an apparatus including a lower turn table having a polishing surface on its upper surface and a rotational axis, an upper turn table having a polishing surface on its lower surface and provided so as to have a rotational axis coaxial with the rotational axis of the lower turn table, one or plural number of intermediate turn tables each having a polishing surface on its upper and lower surfaces and interposed between the lower turn table and the upper turn table so as to have a rotational axis coaxial with the rotational axis of the upper and lower turn tables, a carrier rotating mechanism adaptable to rotate a disk-like carrier on the axis thereof while revolve the disk-like carrier around the rotational axis of the turn tables, and a table rotating mechanism for rotating the tables on rotational axis thereof, comprising the steps of:

preparing disk-like carriers with a plurality of apertures on the upper surface of the lower turn table and the upper surface of each of the one or plural number of intermediate turn tables;

charging works into the carriers at the apertures thereof; and rotating each of the carriers on axis thereof while revolving the carriers around the rotational axis of the turn tables simultaneously with rotating the lower, upper and the one or plural number of intermediate turn tables.

17. A polishing apparatus comprising:

a lower turn table having a polishing surface on its upper surface and a rotational axis;

an upper turn table having a polishing surface on its lower surface and provided so as to have a rotational axis coaxial with the rotational axis of the lower turn table;

plural number of intermediate turn tables each having a polishing surface on its upper and lower surfaces and interposed between the lower turn table and the upper turn table so as to have a rotational axis coaxial with the rotational axis of the upper and lower turn tables;

a lifting and lowering mechanism for lifting and lowering the upper turn table and the one or plural number of intermediate turn tables and;

a carrier rotating mechanism for rotating each of the carriers on axis thereof while revolving the carriers around the rotational axis of the turn tables; and a table rotating mechanism for driving the lower, upper and intermediate turn tables.

18. A polishing method for use with an apparatus including a lower turn table having a polishing surface on its upper surface and a rotational axis, an upper turn table having a polishing surface on its lower surface and provided so as to have a rotational axis coaxial with the rotational axis of the lower turn table, one or plural number of intermediate turn tables each having a polishing surface on its upper and lower surfaces and interposed between the lower turn table and the upper turn table so as to have a rotational axis coaxial with the rotational axis of the upper and lower turn tables, a lifting and lowering mechanism for lifting and lowering the upper turn table and the one or plural number of intermediate turn tables, a carrier rotating mechanism adaptable to rotate a disk-like carrier on the axis thereof while revolving the disk-like carrier around the rotational axis of the turn tables, and a table rotating mechanism for rotating the tables on the rotational axis thereof, comprising the steps of:

lifting the upper turn table and the one or plural number of intermediate turn table so as to allow access to the carriers on the lower turn table and the intermediate turn table;

preparing sheet-like carriers with a plurality of apertures on the upper surface of the lower turn table and the upper surface of the one or plural number of intermediate turn tables;

charging works into the carriers at the apertures thereof;

lowering the upper turn table and intermediate turn table and so that the turn tables are brought to contact to the works held in the carriers on the lower turn table and the one or plural number of intermediate turn tables; and rotating each of the carriers on axis thereof while revolving the carriers around the rotational axis of the turn tables simultaneously with rotating the lower, upper and the one or plural number of intermediate turn tables.

* * * * *